US005533955A

United States Patent [19]

Cann et al.

[11] Patent Number: 5,533,955

[45] Date of Patent: Jul. 9, 1996

[54] APPARATUS FOR FORMING LOOSE FILL PACKING MATERIAL

[75] Inventors: Ronald Cann; Steve Cann, both of Pompano Beach; Robert Lee, Parkland; Kevin J. Haggerty, Parkland, all of Fla.

[73] Assignee: Ecotone of Broward, Inc., Boca Raton, Fla.

[21] Appl. No.: 184,557

[22] Filed: Jan. 21, 1994

[51] Int. Cl.[6] ..... B07B 1/14; B05D 3/12

[52] U.S. Cl. ..... 493/342; 427/290; 241/19; 241/60; 493/373

[58] Field of Search ..... 493/328, 343, 493/340, 342, 369, 373, 967; 427/4, 212, 220, 221, 324, 325, 326, 289, 290, 291, 293; 241/19, 60, 79, 79.1; 83/100, 451

[56] References Cited

U.S. PATENT DOCUMENTS

| | | | |
|---|---|---|---|
| 3,962,181 | 6/1976 | Deloy et al. | 241/79.1 |
| 4,041,816 | 8/1977 | Shearon | 83/100 |
| 4,070,202 | 1/1978 | Nollet | 241/19 |
| 4,168,034 | 9/1979 | Leger | 241/79.1 |
| 4,867,866 | 9/1989 | Mayberry | 241/79.1 |
| 5,024,862 | 6/1991 | Frank | 427/290 |
| 5,035,164 | 7/1991 | Cremona | 83/100 |
| 5,156,075 | 10/1992 | Campbell, Jr. et al. | 83/100 |
| 5,163,627 | 11/1992 | Bouche | 241/79.1 |
| 5,312,665 | 5/1994 | Pratt et al. | 493/967 |
| 5,340,638 | 8/1994 | Sperner | 493/342 |

*Primary Examiner*—Jack W. Lavinder
*Assistant Examiner*—Christopher W. Day
*Attorney, Agent, or Firm*—Holland & Knight

[57] ABSTRACT

An apparatus for forming loose fill packing material which comprises a shredder device operative to convert sheets of corrugated cardboard into elongated, thin paper strips which are discharged onto a perforated conveyor movable between a loading position at the shredder device and a discharge position where the strips are emptied into a collection hopper. A suction device is mounted beneath the conveyor, downstream from the shredder device, which is operative to apply a suction to the cardboard strips to remove dirt, dust and other foreign materials therefrom, and then the cleaned paper strips are transmitted along an angled sifter plate having a plurality of openings which are sized to allow undesired, short strips of paper to pass therethrough for deposit into a waste hopper. A spraying device is located at the sifter plate to deposit a liquid material on the paper strips having microbicidal, sanitizing, insect repellant, disinfectant and deodorizing properties.

14 Claims, 5 Drawing Sheets

APPARATUS FOR FORMING LOOSE FILL PACKING MATERIAL

FIELD OF THE INVENTION

This invention relates to an apparatus for converting corrugated cardboard boxes into loose fill packing material comprising elongated strips of cardboard which are substantially free of dirt, dust and other contaminants, and, which are coated with a liquid material having microbicidal, sanitizing, insect repellant, disinfectant and deodorizing properties.

BACKGROUND OF THE INVENTION

A wide variety of items are shipped in containers which must be at least partially filled with packing material in order to prevent breakage or damage to such items. One of the most popular forms of packing material is formed of polystyrene or "Styrofoam" fabricated in a generally cylindrical shape, commonly known as a "peanut." In most instances, a layer of Styrofoam peanuts is first placed at the bottom of the container, the item to be shipped is positioned atop such layer and then additional Styrofoam peanuts are introduced into the container along the sides and top of the item to complete the packing operation.

One problem with the use of Styrofoam peanuts as loose fill packing material is that items tend to shift, settle or creep within the container in the course of shipment. It has been found that the Styrofoam peanuts tend to move relative to one another, and, in turn, permit movement of items they surround to the bottom or sides of the shipping container where damage to such items can occur.

This problem of shifting of items within a shipping container has been solved to some extent by the use of other packing materials in addition to or as a replacement for the Styrofoam peanuts. For example, a blow-in foam has been utilized with Styrofoam peanuts to enhance the shock absorbing and encapsulating properties of the packing material, but this adds substantial expense and time to the packing operation. Other packing materials such as "bubble-pack", i.e. sheets of plastic material having encapsulated pockets of air, have also been used as an addition to or substitute for Styrofoam peanuts. Unfortunately, bubble-pack is also expensive and can be difficult to work with depending upon the size, shape and/or weight of an item to be shipped.

Another problem with Styrofoam peanuts and other types of foam packing materials is that they promote the formation of static electricity within the shipping container. The presence of static electricity in packing materials can create substantial problems with sensitive electrical components. Additionally, electrostatically charged foam material tends to attract contaminants and other impurities which make their use in the shipment of food items and similar articles undesirable. Although the development of an electrostatic charge on Styrofoam peanuts and other types of foam packing materials can be reduced by the addition of an antistatic agent, the process of applying an antistatic agent to such packing materials is expensive both in terms of material cost and labor.

Styrofoam peanuts, blow-in foam, bubble-packaging and other types of plastic packing material all create a disposal problem and can be dangerous to the environment. Plastic materials are inert and do not biodegrade when placed in a landfill, and therefore take up a large quantity of space. Additionally, a chemical leaching can take place with certain types of plastics which creates environmental problems such as pollution of groundwater supplies and other hazards. A number of states currently have legislation pending to reduce or eliminate the dumping of Styrofoam products and other types of plastics within sanitary landfills, and this could pose a significant disposal problem for companies employing loose fill material formed of plastic or who receive products packaged in such material.

SUMMARY OF THE INVENTION

It is therefore among the objectives of this invention to provide an apparatus for forming a loose fill packing material which is simple and economical in operation, which eliminates dust, dirt and other contaminants from the packing material, which produces packing material of substantially uniform size, and, which applies a liquid treatment material to the packing material.

These objectives are accomplished in an apparatus for forming loose fill packing material which comprises a shredder device operative to convert sheets of corrugated cardboard into elongated, thin paper strips which are discharged onto a perforated conveyor movable between a loading position at the shredder device and a discharge position where the strips are emptied into a collection hopper. A suction device is mounted beneath the conveyor, downstream from the shredder device, which is operative to apply a suction to the cardboard strips to remove dirt, dust and other foreign materials therefrom for deposit into a throwaway collector bag. After passing over the suction device, the cleaned paper strips are transmitted along an angled sifter plate having a plurality of openings which are sized to allow undesired, short strips of paper to pass therethrough for deposit into a waste hopper. Preferably, a spraying device is located at the sifter plate to deposit a liquid material on the paper strips having microbicidal, sanitizing, insect repellant, disinfectant and deodorizing properties.

This invention is predicated upon the concept of providing an efficient and economical apparatus for the formation of cleaned and sanitized paper strips from sections or sheets of used corrugated, cardboard boxes which would otherwise be disposed of in a landfill or the like. The paper strips are formed by a commercially available shredder device, but are then treated in several respects before being suitable for use as packing material.

In order to obtain "clean" paper strips, the dirt and dust therefrom falls by gravity through the perforated conveyor onto ramps located beneath the conveyor on either side of the suction device. These ramps are angled downwardly from the conveyor to direct the dirt and dust which falls thereon into a waste bin for collection. As noted above, the suction device applies a suction to the strips to remove any dirt, dust and other contaminants which remain thereon after travelling along the conveyor. In the event any strips of a comparatively short length are formed in the shredding operation, such shorter strips are removed from the remaining strips in the course of passage along the sifter plate formed with openings operative to "sift" or allow the passage of short strips therethrough. Finally, the remaining material strips are treated with a liquid having the properties noted above to further ensure that the packing material is clean and suitable for use with items of all types.

The loose fill packing material produced by the apparatus of this invention has a number of advantages over Styrofoam peanuts, blow-in foam materials, bubble-packaging and similar plastic packing materials. The paper strips formed by the apparatus herein are biodegradable and environmentally safe unlike Styrofoam peanuts and other types of plastic packaging materials which are inert, and, are often subject to chemical leaching which can release dangerous chemicals to the environment. The paper strips herein are denser than the lightweight, Styrofoam peanuts currently used in many loose fill packaging applications, which makes them easier to handle and collect both during the packing operation and when the item is removed from the shipping container. The paper strips of this invention readily conform to the shape of the item being shipped and substantially resist shifting, settling or creeping of the item within the container in the course of shipment while providing superior insulation and shock absorption properties. Additionally, the paper strips herein formed from corrugated cardboard sheets do not promote the formation of an electrostatic charge and need no antistatic agents in order to safely ship sensitive electrical components and the like. Further, the overall cost of the paper strips of this invention is reduced compared to other loose fill packing materials because it reduces breakage of the items shipped, it can be disposed of by the customer with normal cardboard disposal equipment or containers, and/or the paper strips can be reused in subsequent shipping applications.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
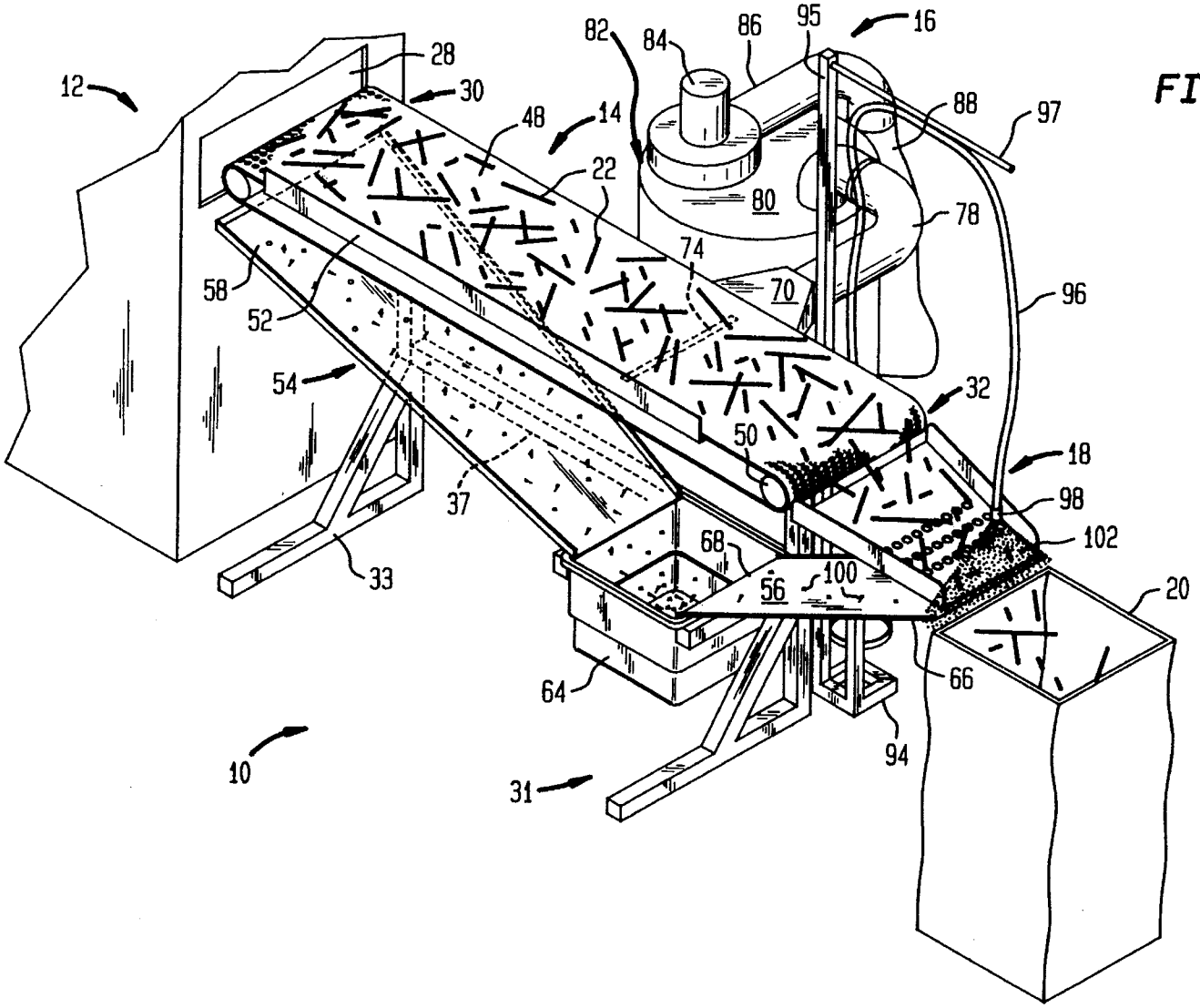
FIG. 1 is an overall perspective view of the apparatus of this invention.

Referring now to the FIGS., the apparatus 10 of this invention comprises a shredder device 12, a conveyor 14, a suction device 16 and a sifter plate 18 which feeds a collection hopper 20. The various elements of apparatus 10 are discussed separately below, followed by a description of the operation of apparatus 10 in forming paper strips 22.

The detailed structure and operation of the shredder device 12 forms no part of this invention of itself and is therefore not discussed in detail herein. It is contemplated that shredders of the type sold by Industrial Shredder and Cutter Co. of Salem, Ohio, under Model No. 16 and/or 16B, would be suitable for use in the apparatus 10 of this invention. Paper shredder devices 12 of this type include a paper inlet 24 which receives corrugated paper (not shown) in the form of sheets salvaged from used corrugated cardboard boxes or other sources of corrugated paper. The shredder device 12 is effective to cut or shred the corrugated paper into thin, elongated paper strips 22 preferably having a length in the range of about 2 to 14 inches, and a width in the range of about ⅛ to ¼ inches and preferably about ⅛inch. The thickness of the paper strips 22 depends on the flute type of the corrugated cardboard being shredded, and it is contemplated that both single and double walled cardboard could be utilized to form paper strips 22, although triple wall cardboard may also be suitable. It should be understood that the length and width of the material strips 22 produced by shredder device 12 may vary with the type of shredder machine employed and the dimensions of the corrugated cardboard sheets. For example, the length of the paper strips 22 could be up to 24 inches, if desired. The above dimensions are therefore given by way of example of the normal or preferred size ranges of paper strips 22 but are not intended to be exhaustive of all possible sizes.

Figure 3:
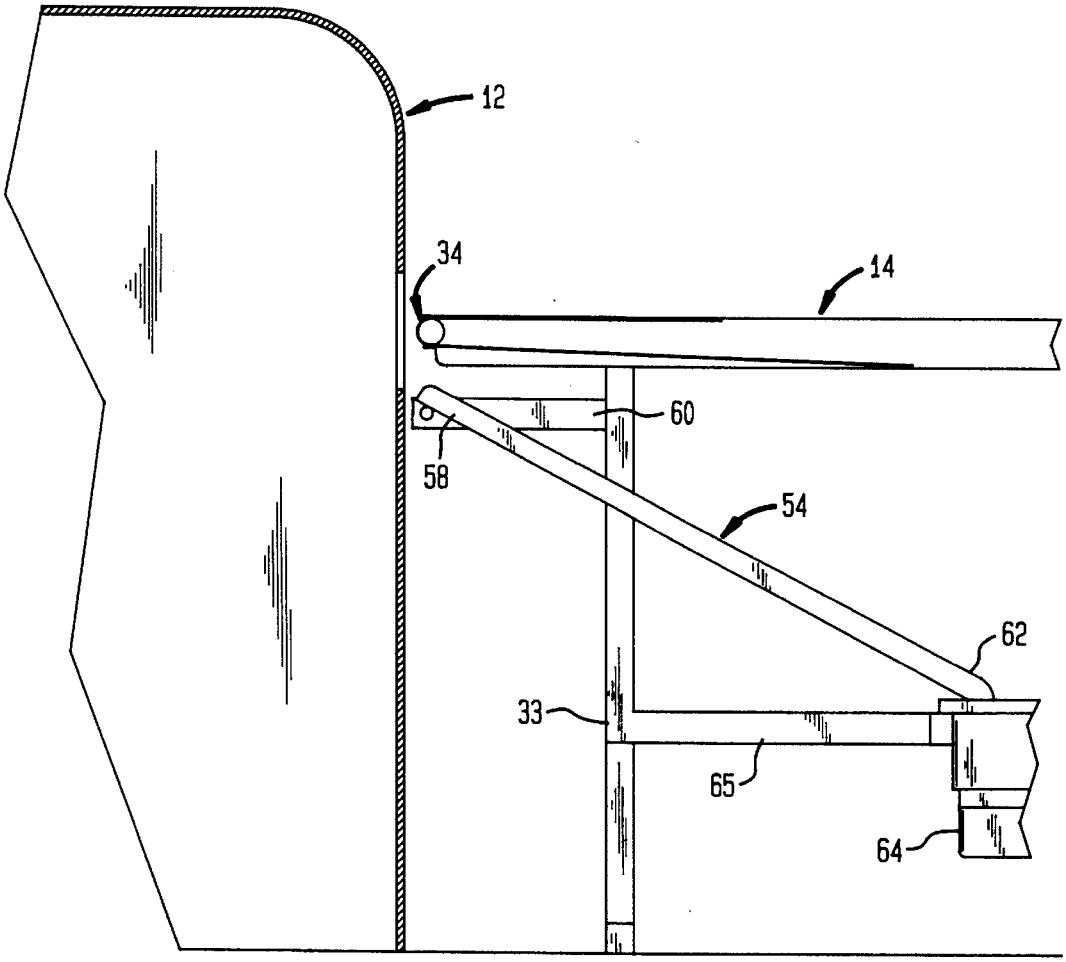
FIG. 3 is a side view of or end of the conveyor this invention.

The shredder device 12 is formed with an outlet 28 from which the material strips 22 are emitted and dumped onto the input end 30 of conveyor 14. The opposite, discharge end 32 of conveyor 14 is located immediately adjacent the sifter plate 18 in position to dump the paper strips 22 thereon, as discussed below in connection with the operation of apparatus 10. The conveyor 14 is mounted on a support stand 31 having spaced vertical legs 33, 35 and a horizontal support 37 extending therebetween. As shown in FIG. 3, the support stand 31 abuts the input end 30 of conveyor 14 against the shredder device 12 in position to receive the paper strips 22.

In the presently preferred embodiment, the conveyor 14 includes a drive roller 34 having a internal motor (not shown) where is effective to rotate the drive roller 34 or a selected speed. The drive roller 34 receives an endless, perforated belt 48 which is looped around an idler roller 50 located at the discharge end 32 of the conveyor 14. Preferably, the perforated belt 48 is at least partially enclosed along its side edges by a frame 52 which extends from the outlet 28 of shredder device 12 at least part way along conveyor 14.

In the course of forming the paper strips 22 by the shredder device 12, dirt, dust and other foreign materials are produced which must be removed from the paper strips 22 to make them suitable for use as packing material. Additionally, shorter or undersized paper strips can be produced by the shredder 12 depending upon the particular configuration of a cardboard sheet to be shredded. The apparatus 10 of this invention includes a number of different structural elements for removing undersized strips, dust, dirt and other contaminants from the paper strips 22 before they are deposited into the collection hopper 20.

Figure 2:
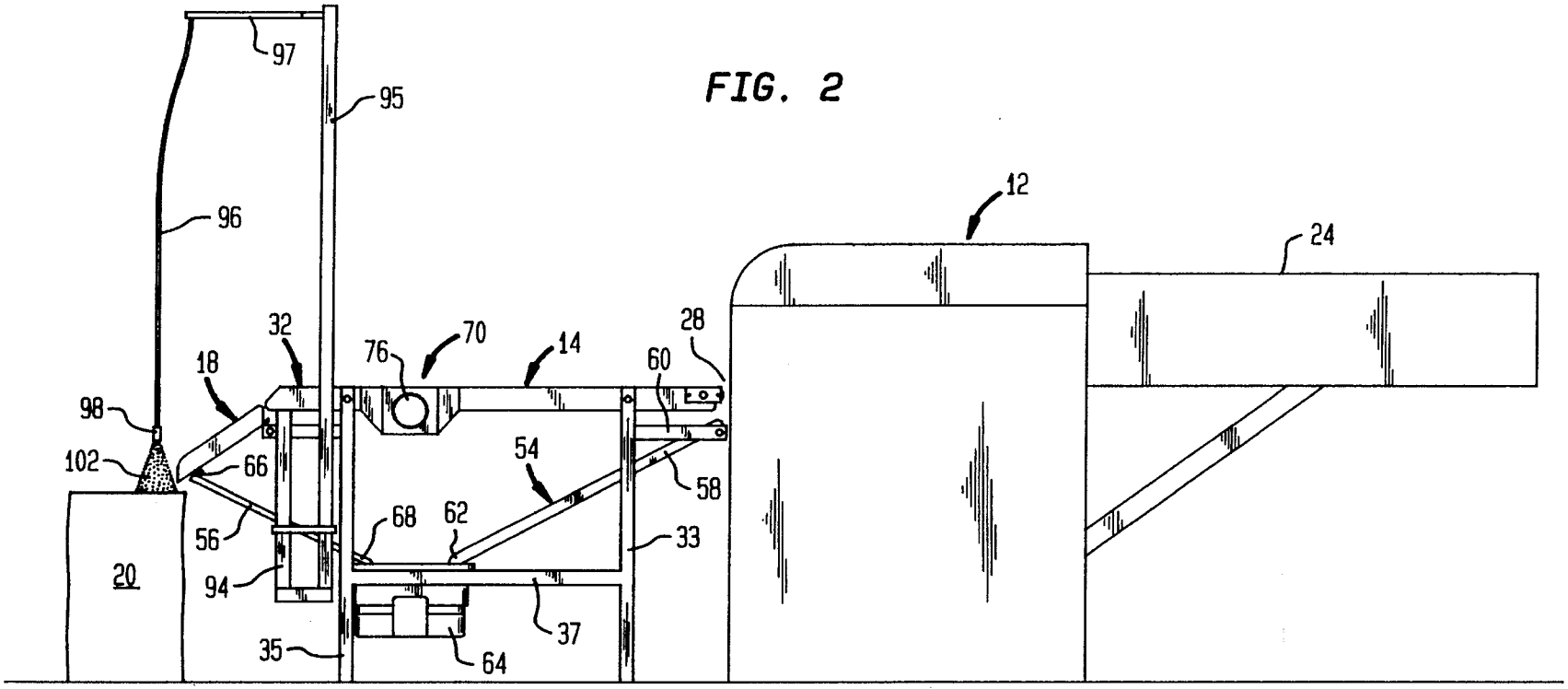
FIG. 2 is a side view of the apparatus shown in FIG. 1.

With reference to FIGS. 1 and 2, a pair of collection ramps 54 and 56 are located beneath the perforated belt 48 of conveyor 14 to catch any dirt, dust or small paper particles from the paper strips 22 which can pass through the perforations in conveyor belt 48. The collection ramp 54 includes an upper end 58 located immediately beneath the perforated belt 48 at the input end 30 of conveyor 14, which is connected to a horizontal support 60 which extends from the vertical leg 33 of support stand 31. The collection ramp 54 angles downwardly from its upper end 58 to a lower end 62 connected to one side of a waste bin 64 located beneath the conveyor 14. The waste bin 64 is mounted in position by a horizontal support 65 carried by the vertical leg 35 of support stand 31. Similarly, the collection ramp 56 angles vertically downwardly from a position partially beneath the conveyor 14 and beneath the sifter plate 18. As shown in FIGS. 1 and 2, the upper end 66 of collection ramp 56 is connected to the discharge end of sifter plate 18, and the lower end 68 thereof is mounted to the waste bin 64. As described in more detail below in connection with a discussion of the operation of apparatus 10, the collection ramps 54, 56 are effective to collect dust, dirt and other waste materials which fall through the perforated belt 48 and transmit such materials to the waste bin 64 for disposal.

Figure 4:
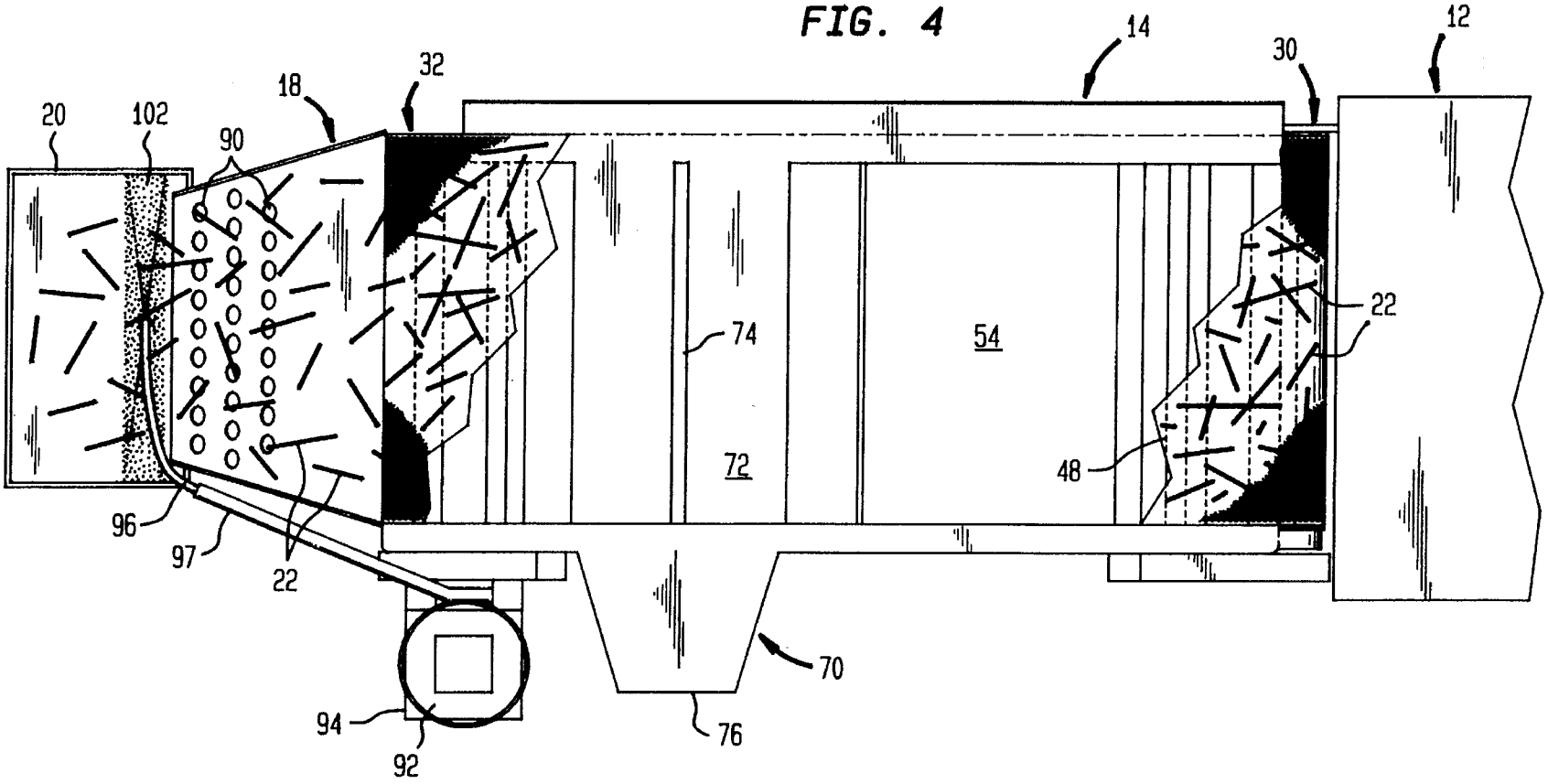
FIG. 4 is a plan view of the apparatus shown in FIG. 1.

Another important structural element of this invention for "cleaning" the paper strips 22 is the vacuum device 16 best shown in FIGS. 1, 2 and 4. The vacuum device 16 comprises a housing 70 mounted beneath the perforated belt 48 of conveyor 14 in a position near its discharge end 32. The housing 70 has an upper plate 72 formed with an elongated slot 74 which extends substantially perpendicularly to .the direction of movement of perforated belt 48 between rollers 34 and 46 of conveyor 14. The housing 70 is also formed with an outlet 76 which is connected by a duct or conduit 78 to an inlet formed in the top wall 80 of a drum 82. This top wall 80 mounts a vacuum pump 84 having an exhaust duct or tube 86 connected to a collector bag 88. As described in more detail below, the vacuum pump 84 is effective to create a negative pressure or suction within the housing 70 to assist in "cleaning" of the paper strips 22 formed by shredder device 12.

Figure 5:
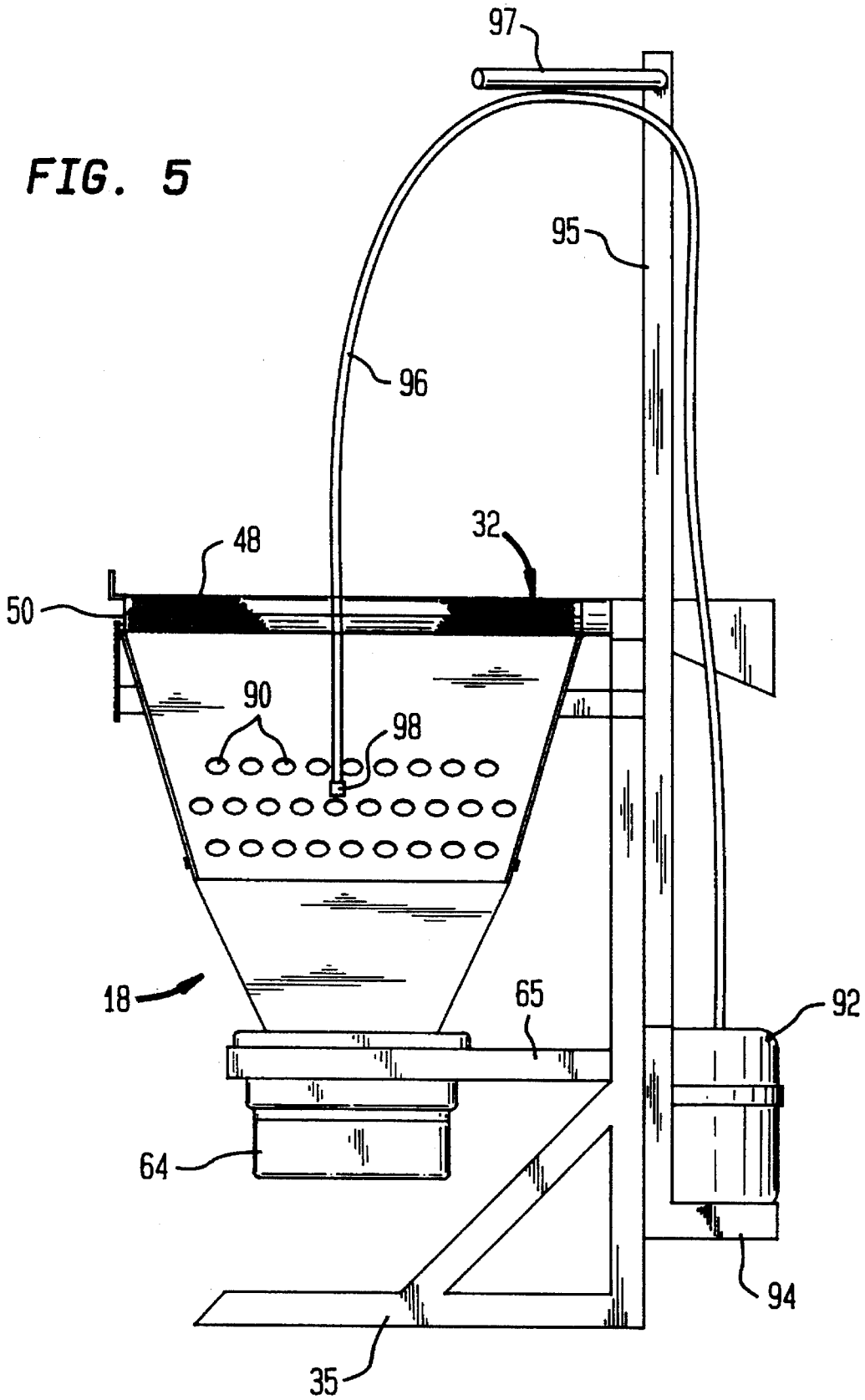
FIG. 5 is a view of the discharge end of the apparatus herein.

After passing over the vacuum housing 70, the paper strips 22 are dumped onto the sifter plate 18 for transmission into the collection hopper 20. As depicted in FIGS. 1, 4 and 5, the sifter plate 18 is mounted at one end to the vertical leg 35 of support stand 31 and at the opposite end to the collection ramp 56. In the presently preferred embodiment, the sifter plate 18 is formed with a number of openings 90 which are depicted as round in configuration but could be formed in other shapes. The largest cross section or diameter of the openings 90 is preferably on the order of about 1 to 2 inches to permit the passage of undersized, short paper strips therethrough which are deposited onto the collection ramp 56 for transmittal into waste bin 64.

In the presently preferred embodiment, a tank 92 filled with liquid treatment material is carried within a support 94 affixed to the vertical leg 35 of support stand 31. The support 94 includes an elongated, vertical leg 95 which supports an arm 97. The tank 92 is connected to a hose 96 carried by the arm 97 of support 94. The hose 96 has a nozzle 98 at one end which is effective to apply liquid treatment material 102 within the tank 92 onto the paper strips 22 entering the collection hopper 20. Preferably, the liquid treatment material within tank 92 has one or more of the following properties: microbicidal, sanitizing, insect repellant, disinfectant and deodorizing.

OPERATION OF APPARATUS

The operation of apparatus 10 proceeds as follows. It is contemplated that in many applications, corrugated paper sheets from used cardboard shipping containers and the like will be utilized to form the paper strips 22 of this invention. Preferably, all staples, tape and any other foreign materials are removed from such corrugated cardboard sheets before being input to the shredder device 12.

As noted above, the shredder device 12 is effective to shred or cut the sheets of corrugated paper to form elongated, thin paper strips 22. These paper strips 22 are emitted from the shredder device 12 onto the perforated belt 48 of conveyor 14. In the course of the shredding operation, a quantity of dirt, dust and the like is formed, some of which remains on the paper strips 22. In order to "clean" the paper strips 22, i.e. remove such unwanted dirt and dust, the apparatus 10 employs the collection ramps 54, 56 and suction device 16. Initially, the paper strips 22 travel along the conveyor 22 before they reach the suction device 16, and any dust or dirt which can be dislodged by gravity falls through the perforated belt 48 of conveyor 14 onto the collection ramp 54. The collected material then slides by gravity along collection ramp 54 into waste bin 64 for disposal.

Most or all of the remaining dust, dirt and the like is removed from the paper strips 22 by operation of suction device 16. As noted above, the vacuum pump 84 creates a negative pressure or suction within the interior of housing 70 through the conduit 78 connected therebetween. This suction creates a flow of ambient air from outside of the housing 70 into its interior through the elongated slot 74 in the upper plate 72. The flow of air entrains dust, dirt or other contaminants on or around the paper strips 22 and draws such materials through the perforated belt 48 of the conveyor 12. The air-entrained dirt and dust flows through elongated slot 74 in the upper plate 72 of housing 70, out the housing outlet 76 into conduit 78 and then into the drum 86 where it is discharged through the exhaust duct 86 thereof into the collector bag 88 for disposal. After passing over the suction housing 70, the paper strips 22 are substantially "cleaned" of dirt, dust and the like.

Depending upon the shape of the corrugated paper sheets fed to the shredder device 12, there may be some instances in which shorter or irregular shaped material strips 100 are formed and deposited onto the conveyor 14. If these shorter material strips 100 are too large to pass through the perforated belt 38 by gravity or under the application of suction within suction housing 70, they continue to move along the perforated belt 48 to its discharge end 32. In order to remove these shorter or nonuniform material strips 100 from the remaining paper strips 22, the apparatus 10 herein includes the sifter plate 18. All of the strips 22 and 100 are dumped onto the sifter plate 19 from the discharge end 32 of conveyor 14. The strips 22 and 100 slide by gravity along the sifter plate 18 over the openings 90 therein. The shorter or nonuniform sized strips 100 pass through the openings 90, fall by gravity onto the collection ramp 56, and then slide by gravity into the waste bin 64. The remaining paper strips 22 continue on past the openings 90 in sifter plate 18 and are deposited into the collection hopper 20.

Preferably, as the paper strips 22 are leaving the sifter plate 28, or when they are first deposited into the collection hopper 20, liquid material 102 from the tank 92 is sprayed by nozzle 98 onto the paper strips 22. As noted above, this liquid 102 is environmentally safe and contains a number of properties such as microbicidal, sanitizing, insect repellant, disinfecting and deodorizing. In one presently preferred embodiment, the liquid material 102 has the following elements which are intermixed until uniform and deposited into tank 92:

| Material | % by Weight |
|---|---|
| Isopropyl alcohol 99% VWR | 40 |
| Oil of cederleaf | 0.2 |
| D Limonene | 1 |
| Nonoxynol-12 | 5 |
| Water | 53.7 |
| BTC 2125 M50 | 0.1 |

Preferably, the liquid material 94 is sprayed onto the paper strips 22 in a fine mist from nozzle 98 so that a coating of less than about 1 millimeter in thickness is obtained thereon. As a result, the paper strips 22 within collection hopper 20 are not only "cleaned" of any dust, dirt or other foreign materials, but are also coated with liquid 102 to make them more suitable for use as packing material.

While the invention has been described with reference to a preferred embodiment, it will be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

For example, the method and apparatus for "cleaning" the paper strips 22 is described above as including the application of a negative pressure within the suction housing 70 to draw a stream of ambient air therein within which dirt and dust from the paper strips 22 is entrained. It is also contemplated that a positive pressure could be introduced into suction housing 70 to generate an air flow to impinge against the paper strips 22 to dislodge and remove dust and dirt therefrom, although it is believed that a negative pressure is preferable to avoid dispersion of the dust and dirt.

Therefore, it is intended that the invention not be limited to the particular embodiment disclosed as the best mode contemplated for carrying out this invention, but that the invention will include all embodiments falling within the scope of the appended claims.

We claim:

1. Apparatus for forming strips of material suitable for use in packing, comprising:

a shredder device operative to receive sheet material and to form material strips therefrom;

a conveyor having a perforated belt movable between an input position at which material strips from said shredder device are placed atop said perforated belt, and a discharge position where the material strips are discharged from said perforated belt;

a collection device, located between said input position and said discharge position beneath said perforated belt, for collecting dirt, dust and other contaminants from the material strips which fall by gravity through said perforated belt;

a suction device, located between said input and discharge positions, for removing dust, dirt and other contaminants from the material strips which remain as the material strips move over said collection device.

2. The apparatus of claim 1 in which said collection device includes a ramp located beneath said perforated belt, said ramp extending at a downwardly angled orientation between said input position of said conveyor and a waste bin located beneath said perforated conveyor.

3. The apparatus of claim 1 in which said suction device includes:

a housing having an interior, an upper surface formed with an opening and an outlet, said housing being mounted relative to said endless, apertured belt so that said upper surface of said housing faces said bottom surface of said endless, apertured belt;

a suction unit, connected to said outlet of said housing, for creating a suction within said interior of said housing.

4. The apparatus of claim 3 in which said suction unit comprises:

a drum having an inlet and an outlet, said inlet of said drum being connected to said outlet of said housing;

a vacuum pump mounted to said outlet of said drum for creating a negative pressure therein.

5. The apparatus of claim 1 further including means for spraying a liquid having microbicidal, sanitizing, insect repellant, disinfectant and deodorizing properties onto the material strips.

6. Apparatus for forming strips of material suitable for use in packaging, comprising:

a shredder device operative to receive sheet material and form material strips therefrom;

a conveyor movable between an input position at which material strips from said shredder device are placed onto said conveyor, and a discharge position where the material strips are discharged from said conveyor;

suction means, located between said input and discharge positions, for removing dust, dirt and the like from the material strips and;

sifter means, located at said discharge position, for receiving the material strips from said conveyor and transmitting them to a collector, said sifter means being effective to remove material strips having less than a predetermined length from the remaining material strips in the course of movement therealong.

7. The apparatus of claim 6 in which said sifter means is a sifter plate formed with a number of openings of selected cross section, said plate having an upper end which receives the material strips from said conveyor means and a lower end positioned vertically below said upper end, the material strips sliding by gravity along said plate and over said openings therein so that the material strips having less than said predetermined length fall through said openings.

8. The apparatus of claim 7 further including a first ramp located beneath said sifter plate in position to receive the material strips having less than said predetermined length which pass through said openings in said sifter plate, said first ramp having a discharge end which empties into a waste bin.

9. The apparatus of claim 8 in which said conveyor includes an endless, apertured belt, said apparatus further including a second ramp located beneath said conveyor, said second ramp extending at a downwardly angled orientation between said loading position of said conveyor and said waste bin to deposit dust, dirt and the like from the material strips which pass through said apertured, endless belt.

10. The method of forming strips of material suitable for use in packing, comprising:

transmitting material strips formed from sections of sheet material atop a perforated belt;

moving the material strips past a collection device located beneath the perforated belt;

collecting dust, dirt and the like which falls by gravity through the perforated belt in the course of movement of the material strips above the collection device;

applying a suction to the material strips during movement of the material strips over the collection device to remove any remaining dust, dirt and the like therefrom.

11. The method of claim 10 further including the step of applying a liquid material onto the material strips having microbicidal, sanitizing, insect repellant, disinfecting and/or deodorizing properties.

12. The method of claim 10 in which said step of applying a suction further comprises applying a negative pressure within the interior of a housing over which the material strips are transmitted atop a perforated belt.

13. The method of claim 12 which said step of applying a suction further comprises drawing a flow of air into the interior of the housing from the outside thereof so that dust, dirt and the like from the material strips resting atop the perforated belt are entrained within the flow of air for removal.

14. The method of claim 10 in which said step of collecting dust, dirt and the like which falls through the apertured belt comprises catching the dust, dirt and the like on a ramp located beneath the conveyor and transmitting it into a waste bin for removal.

* * * * *